United States Patent [19]

Mishima et al.

[11] 4,176,532

[45] Dec. 4, 1979

[54] APPARATUS FOR CONTINUOUSLY WASHING FABRIC WITH WATER

[75] Inventors: Takao Mishima, Suita; Shoji Semba, Osaka; Kiichi Ogata; Osamu Funahashi, both of Wakayama, all of Japan

[73] Assignees: Kanebo, Ltd., Tokyo; Wakayama Iron Works, Ltd., Wakayama, both of Japan

[21] Appl. No.: 964,981

[22] Filed: Nov. 30, 1978

Related U.S. Application Data

[63] Continuation-in-part of Ser. No. 887,130, Mar. 16, 1978, abandoned.

[30] Foreign Application Priority Data

Mar. 16, 1977 [JP] Japan ..... 52-29490

[51] Int. Cl.[2] ..... D06B 3/12

[52] U.S. Cl. ..... 68/19; 68/22 R; 68/181 R

[58] Field of Search ..... 68/19, 22 R, 62, 181 R

[56] References Cited

U.S. PATENT DOCUMENTS

| | | | |
|---|---|---|---|
| 1,071,061 | 8/1913 | Lacroix et al. | 68/19 X |
| 3,064,458 | 11/1962 | Grimes | 68/62 X |
| 4,004,879 | 1/1977 | Meier-Windhorst | 68/181 R X |

*Primary Examiner*—Philip R. Coe

*Attorney, Agent, or Firm*—Armstrong, Nikaido, Marmelstein & Kubovcik

[57] ABSTRACT

An apparatus for continuously washing a fabric with water while causing the fabric to travel in a zigzag path and to be immersed many times in washing water, which comprises a washing assembly located above one or more fabric-introducing rolls and below one or more fabric-withdrawing rolls. The washing assembly comprises a plurality of washing units arranged in a vertical multi-stage form, each washing unit comprising a vessel for containing washing water, first and second dipping rolls located in the washing water vessel and first and second guide rolls spaced from the washing water vessel and respectively corresponding to the first and second dipping rolls, the first dipping roll and the second guide roll being located between the second dipping roll and the first guide rolls, in such a manner that a portion of the peripheral surface of the first guide roll, from which portion the fabric leaves the first guide roll, is located above a portion of the peripheral surface of the first dipping roll, with which portion of the first dipping roll the fabric comes into contact, and a portion of the peripheral surface of the second guide roll, from which portion the fabric leaves the second guide roll, is located above a portion of the peripheral surface of the second dipping roll, with which portion of the second dipping roll the fabric comes into contact.

13 Claims, 3 Drawing Figures

APPARATUS FOR CONTINUOUSLY WASHING FABRIC WITH WATER

This application is a continuation-in-part of the copending application Ser. No. 887,130, filed on Mar. 16, 1978, and now abandoned.

FIELD OF THE INVENTION

The present invention relates to an apparatus for continuously washing a continuous fabric such as a woven or knitted fabric, with water, while maintaining the fabric in an opened form.

BACKGROUND OF THE INVENTION

There are various types of apparatus for continuously washing a fabric such as a woven or knitted fabric in an opened form, with water. However, some of the conventional types of washing apparatuses are not satisfactory in that the apparatus has a relatively small washing capacity in spite of its relatively large scale and a relatively poor washing efficiency in spite of its relatively large consumption of washing water.

In order to eliminate the above-mentioned disadvantages, attempts have been made to assemble a plurality of washing units in a vertical multi-stage form. Each washing unit comprises a vessel for containing washing water, a dipping roll for introducing a fabric to be washed into the vessel and a guide roll for withdrawing the fabric from the vessel and forwarding the withdrawn fabric toward the next upper washing unit. Fresh washing water is supplied to a vessel in an uppermost washing unit, and the washing water is subsequently flowed down to a vessel in a next lower washing unit. This type of washing apparatus has an enlarged washing capacity in spite of its relatively small scale and an increased washing efficiency in spite of its relatively small consumption of washing water. However, this type of washing apparatus has the following disadvantages. Usually, in the conventional multi-stage type of washing apparatus, a fabric is withdrawn from the washing vessel and, then, forwarded toward the guide roll through a substantially horizontal path. Then, the fabric is forwarded from the guide roll to a dipping roll in a next upper washing vessel through an upwardly sloping or substantially horizontal path. When the fabric is withdrawn from the washing vessel, a considerable amount of washing water accompanies the fabric.

While the fabric accompanied by the washing water travels along a horizontal path, both selvadges of the fabric are tightened whereas the middle portion of the fabric entirely or locally sags due to the weight of the accompanying washing water, so that the fabric which in a normal condition is in an opened flat form becomes convex in form. Accordingly, the accompanying washing water is collected in the convex-shaped portion of the fabric. Then, the collected washing water overflows from the convex-shaped portion over one of the selvadges of the fabric. This overflow causes the fabric to be tipped from side to side, and almost all of the washing water collected in the convex-shaped portion flows down from the fabric. During the continuous washing operation, the above-mentioned phenomena are frequently repeated. The tipping motion of the fabric results in fluctuations of the tension applied to the opened fabric. This fluctuation of tension in turn results in undesirable formation of wrinkles in the fabric, irregular bending of weft yarns in the fabric and local alternation in the density of the weft yarns in the fabric. These undesirable phenomena frequently occur, especially, in the case of thin woven fabric and result in a decrease in the quality of the washed fabric.

In order to prevent the above-mentioned undesired phenomena which occur in the conventional type washing apparatus, an additional guide roll or bar is located in a middle portion of each horizontal path of the fabric, or the guide roll is located in a location relatively close to the washing vessel. In the former case, the additional roll or bar in each washing unit is effective for preventing the deformation of the opend fabric into the convex form and the formation of wrinkles in the fabric. However, the arrangement of a number of the additional rolls or bars in the washing apparatus results in difficulty in operations inside the washing apparatus, that is, causes the inside of the washing apparatus to be difficult to clean and, further, makes it difficult to initially arrange the fabric among the several rolls and bars along a predetermined fabric path. Also, in the latter case, the location of the guide rolls close to the washing vessel results in a shortened fabric path which causes the washing efficiency of the apparatus to be poor.

In the conventional multi-stage type washing apparatus, the fabric usually approaches the washing vessel upwardly or substantially horizontally from a guide roll. In this case, at least one additional guide roll should be arranged in or above the washing vessel for turning the direction of the moving fabric downward. Accordingly, even if two rolls are located in the washing vessel, one of the rolls is merely utilized as a turning guide roll which is not effective for immersing the fabric in the washing water in the vessel. That is, this guide roll is not effective for enhancing the washing efficiency of the multi-stage type washing apparatus. In order to utilize the above-mentioned two rolls as real dipping rolls for immersing the fabric in the washing water, it is necessary to arrange an additional guide roll or bar above each dipping roll. This additional guide roll or bar causes the washing apparatus to be complicated and to be significantly enlarged.

Under the above-mentioned circumstances, in the conventional multi-stage type washing apparatus, the fabric is allowed to be immersed only once in the washing water in each washing vessel. Accordingly, the washing efficiency of the conventional multi-stage washing apparatus is unsatisfactory.

SUMMARY OF THE INVENTION

An object of the present invention is to provide an apparatus for continuously washing a fabric with water while causing the fabric to travel in a zigzag path and to be immersed many times in washing water, in which apparatus the fabric can be washed with a high washing efficiency in spite of a relatively small consumption of the washing water, and which apparatus has a high washing capacity in spite of its relatively small scale.

Another object of the present invention is to provide an apparatus for continuously washing a fabric with water while causing the fabric to travel in a zigzag path and to be immersed many times in washing water, in which apparatus the washing water accompanying the fabric does not cause the fabric to have undesirable wrinkles, irregularly bent weft yarns or locally altered density of the weft yarns in the fabric, especially, the fabric having a low density of thin weft and warp yarns.

A further object of the present invention is to provide an apparatus for continuously washing a fabric with water while causing the fabric to travel in a zigzag path and to be immersed many times in washing water, which apparatus has a relatively large vacant space in the middle portion of the apparatus, which space is effective for causing the worker's operations in the inside of the apparatus to be easy.

The above-mentioned object can be attained by the apparatus of the present invention which comprises:

at least one roll for introducing a fabric into said apparatus;

a washing assembly located above the introducing roll and comprising a plurality of washing units arranged in a vertical multi-stage form, each washing unit comprising a vessel for containing washing water, first and second dipping rolls located in the washing water vessel and first and second guide rolls spaced from the washing water vessel and respectively corresponding to the first and second dipping rolls, the first dipping roll and the second guide roll being located between the second dipping roll and the first guide roll, a portion of the peripheral surface of the first guide roll, from which portion the fabric leaves the first guide roll, being located above a portion of the peripheral surface of the first dipping roll, with which portion of the first dipping roll the fabric comes into contact, and a portion of the peripheral surface of the second guide roll, from which portion the fabric leaves the second guide roll, being located above a portion of the peripheral surface of the second dipping roll, with which portion of the second dipping roll the fabric comes into contact;

at least one roll for withdrawing the fabric from said apparatus, located above the washing assembly;

means for feeding washing water into an uppermost washing water vessel;

means for connecting each of the washing water vessels, except for the lowermost washing water vessel, to the next lower washing water vessel, and;

means for discharging the waste washing water from the apparatus.

DETAILED DESCRIPTION OF THE INVENTION

Figure 1:
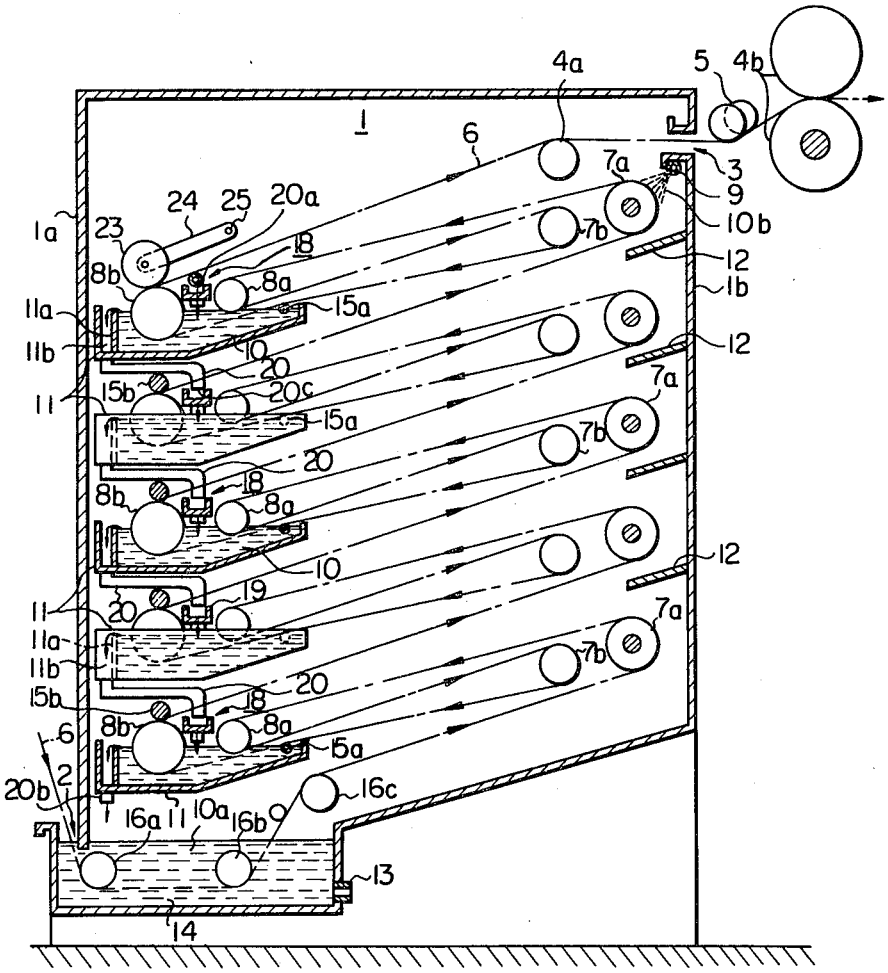
FIG. 1 is a explanatory vertical sectional view of an apparatus of the present invention.

Referring to FIG. 1, a washing chamber 1 is provided with a fabric entrance 2 located in the bottom portion of a side wall 1*a* of the chamber 1 and a fabric exit 3 located in the top portion of the opposite side wall 1*b* of the chamber 1. A group of rolls 16*a*, 16*b* and 16*c* for introducing a fabric 6 into the washing chamber 1 are located adjacent to the fabric entrance 2. Also, a group of rolls 4*a* and 4*b* for withdrawing the fabric 6 from the washing chamber 1 are located close to the fabric exit 3. The two rolls 4*b* form a pair of nip rolls and are driven by driving means (not shown in FIG. 1) at a predetermined constant speed. Between the roll 4*a* and the nip rolls 4*b* there is located an expander roll 5 for spreading the fabric 6 so as to remove wrinkles from the fabric 6. In FIG. 1, the nip rolls 4*b* are arranged close to the fabric exit 3 and in the top portion of the apparatus. However, the location of the nip rolls 4*b* is not limited to the top portion of the apparatus. That is, the nip rolls 4*b* may be arranged in any location of the apparatus as long as the nip rollers 4*b* are located outside the washing chamber 1 and can smoothly withdraw the fabric through the fabric exit 3.

A washing assembly consisting of a plurality of, for example, five, washing units is arranged in a vertical multi-stage form between the introducing rolls 16*a*, 16*b* and 16*c* and the withdrawing nip rolls 4*a* and 4*b*. Each washing unit is provided with a vessel 11 for containing washing water 10, a pair of first and second dipping rolls 8*a* and 8*b* located in the washing vessel 11 and a pair of first and second rolls 7*a* and 7*b* spaced from the washing vessel 11. In the apparatus shown in FIG. 1, five washing vessels 11 and five sets of the first and second dipping rolls 8*a* and 8*b* located in the washing vessels 11 are arranged adjacent to the side wall 1*a* in a vertical five-stage form, and; also, five sets of the guide rolls 7*a* and 7*b* arranged adjacent to the opposite side wall 1*b* in a vertical five-stage form. In the above-mentioned arrangement, it is important that, in each washing unit, the first dipping roll 8*a* and the second guide roll 7*b* are located between the second dipping roll 8*b* and the first guide roll 7*a*. This arrangement results in a small two direction fabric path extending from the first dipping roll 8*a* to the second guide roll 7*b*, around the second guide roll 7*b* and, then, from the second guide roll 7*b* to the second dipping roll 8*b*; which small path is located between a large two direction fabric path extending from the second dipping roll 8*b* of the next lower washing unit, or the introducing rolls 16, to the first guide roll 7*a*, around the first guide roll 7*a*, and then, extending from the first guide roll 7*a* to the first dipping roll 8*a*. Accordingly, the arrangement is effective for providing a very long fabric path within a relatively small space of the washing apparatus and, also, for enhancing the washing efficiency of the apparatus.

It is preferable that the second dipping roll 8*b* have a large diameter than that of the first dipping roll 8*a* and the first guide roll 7*a* have a larger diameter than that of the second guide roll 7*b*. This feature is effective for easily arranging the small two direction fabric path between the large two direction fabric path. In this case, the distance between the longitudinal axes of the second guide roll 7*b* and the first dipping roll 8*a* is preferably in a range of from 70 to 130 cm. All or some of the first guide rolls 7*a* in the washing assembly may be connected to driving means (not shown in FIG. 1), so as to rotate the first guide rolls at a constant speed and enable the fabric to travel at a constant speed under a low tension.

Also, it is very important that a portion of the peripheral surface of the first guide roll 7*a*, from which portion the fabric 6 leaves the first guide roll 7*a*, be located above a portion of the peripheral surface of the first dipping roll 8*a*, with which portion of the first dipping roll 8*a* the fabric 6 comes into contact, and; a portion of the peripheral surface of the second guide roll 7*b*, from which portion the fabric 6 leaves the second guide roll 7*b*, be located above a portion of the peripheral surface of the second dipping roll 8*b*, with which portion of the second dipping roll 8*b* the fabric 6 comes into contact. This above-mentioned arrangement of the first and second dipping and guide rolls cause the fabric 6 to approach the washing water 10 in the washing vessel 11 from the first guide roll 7*a* and the second guide roll 7*b* along a downwardly sloping path. Due to this downward approach, the fabric can be directly introduced into the washing water 10 by means of the first and second dipping rolls 8a and 8b. That is, in the apparatus of the present invention, all of the first and second dipping rolls 8a and 8b located in all the washing vessels 11 can be utilized to directly immerse the fabric into the washing water in the washing vessel 11. Accordingly, no additional guide roll or bar is necessary for introducing the fabric into the washing water. In connection with the above-mentioned arrangement of the first and second guide and dipping rolls, it is preferable that an angle between the horizontal plane and a line drawn from a point on the peripheral surface of the first guid roll, from which point the fabric leaves the first guide roll, to a point on the peripheral surface of the first dipping roll, with which point on said first dipping roll the fabric comes into contact, and an angle between the horizontal plane and a line drawn from a point on the peripheral surface of the second guide roll, from which point the fabric leaves the second guide roll, to a point on the peripheral surface of the second dipping roll with which point on the second dipping roll the fabric comes into contact, be in a range of from 8 to 25 degrees, more preferably, from 10 to 20 degrees, respectively.

In the apparatus of the present invention, the fabric 6 is introduced into a bottom portion of the apparatus through a group of introducing rollers 16a, 16b and 16c, subsequently travels through a plurality of the washing units from the lowermost unit to the uppermost unit, and then, is withdrawn from the top portion of the apparatus through a group of withdrawing nip rolls 4a, 4b and expander roll 5. In this case, if it is assumed that in each washing unit the fabric moves in a straight line from the first guide roll 7a to the second dipping roll 8b, the fabric 6 would travel from the lower to the upper portion of the washing apparatus, through a plurality of the washing units along a zigzag path.

In each washing unit, a first fabric path from the first guide roll 7a to the first dipping roll 8a is located above a second fabric path from the first dipping roll 8a to the second guide roll 7b, which second fabric path is located above a third fabric path from the second guide roll 7b to the second dipping roll 8b. That is, in each washing unit, the fabric travels from an upper portion to a lower portion of the unit along a zigzag path.

Accordingly, in the apparatus of the present invention, the fabric travels along a very long composite path consisting of a zigzag path from the lower to the upper portion of the washing apparatus and a plurality of zigzag paths from an upper to a lower portion of the washing units. This very long path is effective for enhancing the fabric washing efficiency.

Moreover, in the apparatus of the present invention, the fabric 6 leaving the first and second dipping rolls 8a and 8b is moved to the second guide roll 7b or the first guide roll 7a of the next upper washing unit along an upwardly sloping path. It is preferable that in each washing unit the angle between the horizontal plane and a line drawn from a point on the peripheral surface of the second dipping roll 8b of the next lower washing unit, from which point the fabric leaves the second dipping roll 8b, to a point on the peripheral surface of the first guide roll 7a, with which point on the first guide roll to the fabric comes into contact, and an angle between the horizontal plane and a line drawn from a point on the peripheral surface of the first dipping roll 8a, from which point the fabric leaves the first dipping roll 8a, to a point on the peripheral surface of the second guide roll 7b with which point on the second guide roll 7b the fabric comes into contact, be in a range of from 8 to 25 degrees, preferably, from 10 to 20 degrees, respectively.

Figure 2:
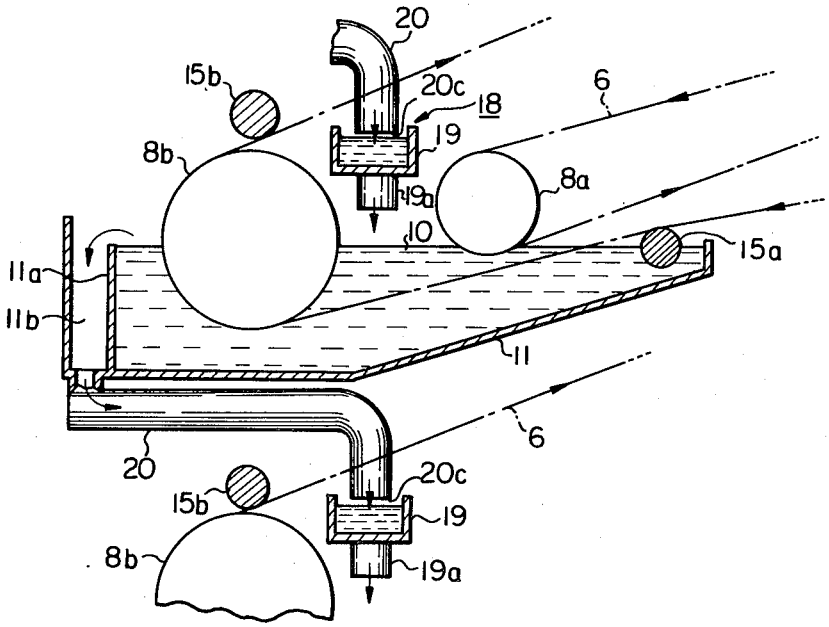
FIG. 2 is an enlarged vertical sectional view of a water vessel and related parts.

Referring to FIGS. 1 and 2, in each washing unit, the washing water vessel 11 is provided with an overflow pit 11b partitioned from the vessel 11 by an overflow partition 11a over which the washing water 10 overflows from the vessel 11 to the overflow pit 11b. Also, in each washing unit, a water supplying device 18 is located above the level of the washing water 10 in the vessel 11. The water supplying device 18 is provided with a trough 19 and a water delivery port 19a connected to a outer portion of the bottom of the trough 19. The trough 19 extends horizontally between the first and second dipping rolls 8a and 8b. The water delivery port 19a has a spouting end directed to the vessel 11.

In the uppermost washing unit, a fresh water supplying pipe 20a is disposed above the uppermost trough 19. The spouting end of the fresh water supplying pipe 20a is directed to the uppermost trough 19.

In each of the washing units except for the lowermost wshing unit, each of two end portions of the bottom of the overflow pit 11b is connected to a water pipe 20. The spouting end 20c of the water pipe 20 is open to the trough 19 of the next lower washing unit. In the lowermost washing unit, the bottom of the overflow pit 11b is connected to a water delivery port 20b for discharging the washing water from the lowermost washing unit toward the bottom of the apparatus.

Referring to FIG. 1, a water reservoir pit 14 is disposed in the bottom of the washing chamber 1. The introducing rolls 16a and 16b are located in the reservoir pit 14. All of the waste water delivered from the rest of the apparatus is collected in the reservoir pit 14. The entrance 2 of the washing chamber 1 is submerged in the collected waste water 10a. The reservoir pit 14 has a discharging conduit 13 located in the lower portion thereof.

Referring to FIGS. 1 and 2, fresh washing water is supplied into the water supplying device 18 of the uppermost washing unit through the fresh water supplying pipe 20a. In the uppermost washing unit, the fresh washing water is fed into the vessel 11 through the water supplying device 18, and used for washing the fabric 6. The water in the vessel 11 overflows into the overflow pit 11b over the overflow partition 11a, and flows down through the water supplying pipe 20 into the water supplying device 18 of the next lower washing unit. In each washing unit, the washing water flows in the same manner as mentioned above. Finally, the washing water in the vessel 11 of the lowermost washing unit flows down into the reservoir pit 14 through the overflow pit 11b and the water delivery pipe 20b. The waste washing water 10a collected in the reservoir pit 14 is discharged to the outside of the apparatus through the discharge conduit 13.

Referring to FIGS. 1 and 2, it is preferable that the lowermost portion of the peripheral surface of the first dipping roll 8a and approximately the lowerhalf portion of the second dipping roll 8b be located below the level of the washing water 10 contained in the washing water vessel 11 when the apparatus is operated.

Due to the above-mentioned location of the first dipping roll 8a, the portion of the peripheral surface of the first dipping roll 8a from which the fabric leaves for the second guide roll 7b, is located slightly below the level of the washing water 10 in the vessel 11, so that the fabric is slightly immersed in the washing water. Accordingly, a very small amount of washing water is allowed to enter between the peripheral surface of the first dipping roll 8*a* and an upper surface of a portion of the fabric just leaving the first dipping roll 8*a*. This feature causes the upper surface of the fabric 6, which leaves the first dipping roll 8*a* for the second guide roll 7*b*, to be accompanied by the very small amount of washing water. Accordingly, the fabric can not become convex in form between the first dipping roll 8*a* and the second guide roll 7*b*. Next, the lower surface of the fabric having thereon the washing water is brought into contact with the peripheral surface of the second guide roll 7*b* and turns around the second guide roll 7*b*. When the lower surface of the fabric comes into contact with the peripheral surface of the second guide roll 7*b*, the washing water adhered to the lower surface of the fabric, which is upwardly moving at a speed, also comes into impact with the peripheral surface of the second guide roll 7*b* and, then, migrates to the opposite surface of the fabric. While the fabric turns about the second guide roll 7*b*, the washing water on the above-mentioned opposite surface of the fabric is splattered, by action of centrifugal force, onto the upper surface of the fabric moving from the second dipping roll 8*b* of the next lower washing unit to the first guide roll 7*a*. In the same manner as mentioned above, the splattered washing water on the upper surface of the fabric migrates to the opposite surface of the fabric when the fabric comes into contact with the peripheral surface of the first guide roll 7*a*. Also, the washing water on the opposite surface of the fabric is thrown out by the centrifugal action while the fabric turns around the first guide roll 7*a*.

The fabric 6 which has left the second guide roll 7*b*, approaches the water vessel 11 along a downwardly sloping path and is introduced into the washing water 10 in the vessel 11. While the fabric travels in the washing water 10 toward the second dipping roll 8*b*, both surfaces of the fabric are exposed to the washing water 10 so as to be washed with the washing water 10. In this case, it is preferable that a guide bar 15*a* be located in the front portion of the vessel 11. The guide bar 15*a* may be located above or below the level of the washing water 10 in the vessel 11, or a lower portion of the guide bar 15*a* may be immersed in the washing water 10, as shown in FIGS. 1 and 2. This guide bar 15*a* is effective for stripping the washing water accompanying the fabric so as to enhance the washing efficiency, for smoothly introducing the fabric into the washing water 10 in the vessel 11 and for allowing the fabric to stably travel to the second dipping roll 8*b* without formation of wrinkles on the fabric. In connection to the guide bar 15*a*, it is preferable that the lowermost portion of the peripheral surface of the first dipping roll 8*a* be extremely close to a line drawn from a point on the peripheral surface of the guide bar 15*a*, from which point the fabric leaves the guide bar 15*a*, to a point on the peripheral surface of the second dipping roll 8*b*, with which point on the second dipping roll 8*b* the fabric comes into contact. The shortest distance between the lowermost portion of the first dipping roll 8*a* and the above-mentioned line is preferably in a range of from 5 to 20 mm. This feature is effective for decreasing the amount of the washing water accompanying the lower surface of the fabric which leaves the first dipping roll 8*a* for the second guide roll 7*b*.

This is because a portion of the washing water accompanying the fabric leaving the first dipping roll 8*a* is stripped by the action of a stream of the washing water accompanying the fabric traveling from the guide bar 15*a* to the second dipping roll 8*b*. This accompanying stream of the washing water generates a turbulent stream of the washing water located around the lowermost portion of the peripheral surface of the first dipping roll 8*a*. This turbulent stream exhibits an excellent washing effect on the fabric.

Each of the washing units may have a stripping bar 15*b* located just above the second dipping roll 8*b*. This stripping bar 15*b* is effective for stripping the washing water accompanying the fabric which just after the fabric leaves the second dipping roll 8*b*, so as to decrease the amount of the washing water carried on the fabric.

In the case of the uppermost washing unit, the stripping bar 15*b* may be replaced by a press roll 23 located on the upper portion of the peripheral surface of the second dipping roll 8*b*. The press roll 23 and the second dipping roll 8*b* form a pair of nip rolls which are effective for squeezing the fabric just after it leaves the washing water 10 in the washing vessel 11. The press roll 23 may be supported by a pair of levers 24 (only one shown in FIG. 1) which are swingable around a shaft 25.

Referring to FIG. 1, the side wall 1*b* is provided with a plurality of guide plates 12 which are downwardly inclined from the side wall 1*b*. Each guide plate 12 is located below each first guide roll 7*a* and its free end is positioned substantially right below the longitudinal axis of the first guide roll 7*a*. Also, a fresh washing water jet pipe 9 is located above and adjacent to the uppermost first guide roll 7*a*. That is, fresh washing water 10*b* is spouted from the jet pipe 9 toward the fabric 6 turning around the uppermost first guide roll 7*a*. A major portion of the spouted washing water 10*b* accompanies the fabric 6 downwardly traveling from the first guide roll 7*a* to the first dipping roll 8*a*, a minor portion of the washing water flows along the fabric 6 entrained on the first guide roll 7*a* and, then, falls down onto the uppermost guide plate 12. The accompanying washing water of the fabric is collected in the washing vessel 11 and reused for washing the fabric dipped in the vessel. The washing water collected on the uppermost guide plate 12, which water is a mixture of the spouted water and the water thrown out from the fabric turning around the first guide roll 7*a*, falls down onto the fabric on the next lower first guide roll 7*a* and, then, almost all of the fallen washing water accompanies the fabric moving to the first dipping roller 8*a* of the next lower washing unit. The above-mentioned performances of the washing water are repeated in each washing unit. The washing water 1*b* is effective for supplementally washing the fabric. The accompanying water on the fabric moving from the first guide roll to the first dipping roll travels at a speed which is the same as or slightly higher than that of the fabric, and therefore, is not be collected on the fabric so as to deform the fabric into a convex form. This feature is effective for preventing the formation of wrinkles on the fabric. An angle between the fabric path from the first guide roll 7*a* to the first dipping roll 8*a* and the horizontal plane in a range of from 8 to 25 degrees is effective for controlling the speed of the accompanying washing water on the fabric to a level the same as or slightly higher than that of the fabric.

The washing action of the washing water on the fabric is effected by immersing the fabric into the washing water in each washing vessel and, in addition thereto, by replacing the washing water carried by the surfaces and the interior of the fabric with another washing water which is cleaner than that carried by the fabric under the stripping action produced by each stripping bar 15*b*. Also, the replacing action of the washing water is carried out while the fabric is pressed onto the peripheral surface of each of the first and second dipping rolls in the washing water.

Besides the above-mentioned washing actions, another washing action is also effected by allowing the washing water to flow along the upper and lower surfaces of the fabric and to move from the upper surface portion to the lower surface portion of the fabric while the fabric travels between the guide roll and the dipping rolls and by spattering the washing water from the fabric by the centrifugal force applied to the fabric while the fabric turns around the guide rolls. Furthermore, the washing is effected by spouting fresh water onto the fabric entrained around the uppermost first guide roll and by allowing the spouted washing water to subsequently flow down onto the fabric entrained on the next lower first guide roll.

As mentioned above, the washing water flows down through the multi-stage washing units and is contaminated little by little by the residue from the fabric. However, since the fabric travels from the lower to the upper portion of the apparatus through the multi-stage washing units along the composite zigzag path, it follows that in each washing stage the fabric is subjected to the washing operation with cleaner washing water than that of the next lower washing stage. Finally, the fabric is washed with absolutely fresh washing water contained in the uppermost washing vessel 11 and spouted through the jet pipe 9, respectively. In addition, depending upon the type of the fabric to be washed, in the case where the fabric can be thoroughly washed by the immersion treatment alone, the fresh water spouting operation from the jet pipe 9 may be dispensed with.

In the above description, the fabric is washed by a single, washing apparatus of the present invention. However, two or more washing apparatuses of the present invention may be connected to each other to form a series of washing apparatus.

Figure 3:
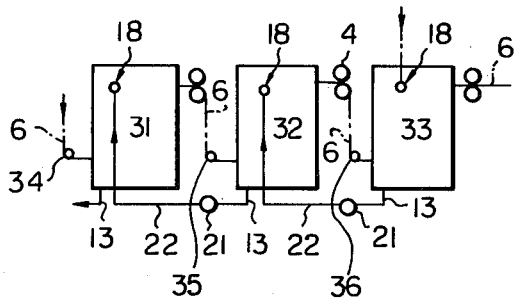
FIG. 3 is a schematic view, illustrating an example in which a plurality of treating apparatuses according to the invention are connected in series.

Referring to FIG. 3, a fabric outlet of the first apparatus 31 is connected to a fabric inlet of the second apparatus 32, and the fabric outlet of the second apparatus 32 is connected to a fabric inlet of the third apparatus 33. Accordingly, a fabric 6 is introduced into the first apparatus 31 through a guide roll 34 and withdrawn therefrom through a pair of nip rolls 4. The fabric 6 is then introduced into the second apparatus 32 through a guide roll 35 and withdrawn therefrom through a pair of nip rolls 4. Finally, the fabric 6 is introduced into the third apparatus 33 through a guide roll 36 and withdrawn therefrom by means of a pair of nip rolls 4. On the other hand, fresh washing water is supplied to an uppermost water supplying device 18 in the third apparatus 33 and the used washing water is withdrawn through a third discharging pipe 13. The withdrawn washing water is fed by means of a second pump 21 through a conduit 22 into the uppermost water supplying device 18 in the second apparatus 32, and withdrawn from the apparatus 32 through a second discharging pipe 13. The withdrawn washing water is fed into the uppermost water supplying device 18 in the first washing apparatus 31 by means of a first pump 21 through a conduit 22, and the waste washing water is discharged from the apparatus 31 through a first discharging pipe 13. In a series of the washing apparatuses as shown in FIG. 3, the washing water can be utilized in a plurality of washing apparatuses for washing the fabric which travels countercurrently to the washing water through the apparatuses. In this case, the washing efficiency is very excellent and, therefore, the jets of the washing water from the jet pipe are sometimes not necessary. However, if such necessity arises, it is easy to apply the jets of the washing water onto the fabric.

In the apparatus of the present invention, a plurality of washing units are arranged in a vertical multi-stage form in a washing space, and a fabric is entrained on the guide and dipping rolls and travels along a composite zigzag path. Each of the fabric paths between the guide rolls and the corresponding dipping rolls are inclined from the horizontal plane. Therefore, the interior of the washing space can be effectively used, so that a large amount of fabric can be easily washed inside a washing space which is relatively small.

In the apparatus of the present invention, the fabric can approach the washing water vessel along a downwardly sloping path. Therefore, all of the dipping rolls located in the washing water vessel can be used for immersing the fabric into the washing water and it is not necessary to arrange an additional guide roll or bar effective merely for introducing the fabric into the washing water, in or just above the washing water vessel.

Contrary to the above, if the fabric were to approach the washing water vessel along an upwardly sloping or horizontal path, at least one of the dipping rolls located in the washing water vessel would have to be used only for turning the fabric toward the washing water in the vessel. That is, in such a case, the turning roll would not be directly effective for immersing the fabric in the washing water.

In the apparatus of the present invention, the fabric can smoothly travel between the guide rolls and the corresponding dipping rolls without deformation of the fabric into a convex form. Therefore, it is unnecessary to arrange additional guide rolls or bars for preventing the deformation of the fabric between the guide rolls and the corresponding dipping rolls. This feature is effective for maintaining the space between the guide rolls and the corresponding dipping rolls vacant.

By using the apparatus of the present invention, the repetitive immersions of the fabric in the successive water vessels assure the saturation of the fabric with water, followed by repetitive squeezing or stripping operations, while keeping the fabric in the treating space for a long time. This assures effective replacement of the remaining chemicals in the fabric by fresh water.

In the apparatus of the present invention, any desired guide and dipping roll, in addition to the withdrawing roll, may be positively driven, so as to enable the fabric to travel under a low tension, which means that the washing treatment of the fabric can be smoothly carried out without undesirable deformation of the fabric.

In the apparatus of the present invention, an overflow system of the washing water is utilized, whereby washing water is supplied to the water vessels arranged in a vertical multi-stage form. That is, the washing water overflows from a water vessel into the next lower vessel, so that the amount of water to be used can be minimized. Since the uppermost water vessel is maintained full of fresh water, it is possible to completely wash the fabric.

In the apparatus of the present invention, since a plurality of the washing units are arranged in a vertical multi-stage form in the treating space so as to form the composite zigzag path of the fabric, the efficiency of utilization of the inside space is higher than that of the conventional washing apparatuses and the worker's operations in the inside of the apparatus of the present invention are easier than in the conventional apparatuses.

While there have been described herein what are at present considered preferred embodiments of the several features of the invention, it will be obvious to those skilled in the art that modifications and changes may be made without departing from the essence of the invention. It is therefore, to be understood that the exemplary embodiments described are illustrative and not restrictive of the invention, the scope of which is defined in the appended claims, and that all modifications that come within the meaning and range of equivalency of the claims are intended to be included therein.

What we claim is:

1. An apparatus for continuously washing a fabric with water while causing the fabric to travel in a zigzag path and to be immersed many times in washing water, said apparatus comprising:

at least one roll for introducing a fabric into said apparatus;

a washing assembly located above said introducing roll and comprising a plurality of washing units arranged in a vertical multi-stage form, each washing unit comprising a vessel for containing washing water, first and second dipping rolls located in said washing water vessel and first and second guide rolls spaced from said washing water vessel and respectively corresponding to said first and second dipping rolls, said first dipping roll and said second guide roll being located between said second dipping roll and said first guide roll, a portion of the peripheral surface of said first guide roll, from which portion the fabric leaves said first guide roll, being located above a portion of the peripheral surface of said first dipping roll, with which portion of said first dipping roll the fabric comes into contact, and a portion of the peripheral surface of said second guide roll, from which portion the fabric leaves said second guide roll, being located above a portion of the peripheral surface of said second dipping roll, with which portion of said second dipping roll the fabric comes into contact;

at least one roll for withdrawing said fabric from said apparatus, located above said washing assembly;

means for feeding washing water into an uppermost washing water vessel;

means for connecting each of said washing water vessels, except for the lowermost washing water vessel, to the next lower washing water vessel, and;

means for discharging the waste washing water from said apparatus.

2. An apparatus as claimed in claim 1, wherein an angle between the horizontal plane and a line drawn from a point on the peripheral surface of the first guide roll, from which point the fabric leaves said first guide roll, to a point on the peripheral surface of the first dipping roll, with which point on said first dipping roll the fabric comes into contact, and an angle between the horizontal plane and a line drawn from a point on the peripheral surface of said second guide roll, from which point the fabric leaves said second guide roll, to a point on the peripheral surface of said second dipping roll with which point on said second dipping roll the fabric comes into contact, are in a range of from 8 to 25 degrees, respectively.

3. An apparatus as claimed in claim 2, wherein said angles are in a range of from 10 to 20 degrees.

4. An apparatus as claimed in claim 1, wherein said second dipping roll has a larger diameter than that of said first dipping roll and said first guide roll has a larger diameter than that of said second guide roll.

5. An apparatus as claimed in claim 1, wherein said washing water vessel is provided with an overflow pit partitioned from said vessel by an overflow partition over which the washing water overflows from said vessel to said overflow pit, said overflow pit being connected to the next lower washing water vessel by said connecting means.

6. An apparatus as claimed in claim 1, wherein an angle between the horizontal plane and a line drawn from a point on the peripheral surface of the first dipping roll, from which point the fabric leaves said first dipping roll to a point on the peripheral surface of the second guide roll, with which point on said second guide roll the fabric comes into contact, and an angle between the horizontal plane and a line drawn from a point on the peripheral surface of said second dipping roll, from which point the fabric leaves said second dipping roll, to a point on the peripheral surface of said first guide roll of the next upper washing unit, with which point on said first guide roll the fabric comes into contact, are in a range of from 8 to 25 degrees, respectively.

7. An apparatus as claimed in claim 6, wherein said angles are in a range of from 10 to 20 degrees.

8. An apparatus as claimed in claim 1, wherein a lowermost portion of the peripheral surface of said first dipping roll and approximately the lowerhalf portion of said second dipping roll are respectively located below the level of said washing water contained in said washing water vessel when said apparatus is operated, and a guide bar is located between said second dipping roll and said second guide roll and within said washing water vessel.

9. An apparatus as claimed in claim 8, wherein said lowermost portion of the peripheral surface of said first dipping roll is extremely close to a line drawn from a point on the peripheral surface of said guide bar, from which point the fabric leaves said guide bar, to a point on the peripheral surface of said second dipping roll, with which point on said second dipping roll the fabric comes into contact.

10. An apparatus as claimed in claim 9, wherein the shortest distance between said lowermost portion of the peripheral surface of said first dipping roll and said line between said guide bar and said second dipping roll is in a range of from 5 to 20 mm.

11. An apparatus as claimed in claim 1, wherein a stripping bar is located between said second dipping roll and a first guide roll of the next upper washing unit and just above said second dipping roll.

12. An apparatus as claimed in claim 1, wherein a press roller is located on the upper portion of the peripheral surface of said second dipping roll in the uppermost washing unit, so as to provide a pair of nip rolls.

13. An apparatus as claimed in claim 1, wherein said first guide roll is connected to means for driving said first guide roll.

* * * * *